United States Patent [19]

Brown

[11] 4,353,529

[45] Oct. 12, 1982

[54] IMPACT ABSORBING HANDRAIL AND END CAP

[76] Inventor: Russell L. Brown, 1620 Kingsbury La., Oklahoma City, Okla. 73116

[21] Appl. No.: 93,832

[22] Filed: Nov. 13, 1979

[51] Int. Cl.[3] ..... E04H 17/14

[52] U.S. Cl. ..... 256/59; 248/345.1

[58] Field of Search ..... 256/59, 65; 248/345.1, 248/251

[56] References Cited

U.S. PATENT DOCUMENTS

| | | | |
|---|---|---|---|
| 3,825,229 | 7/1974 | Bartlett | 256/59 |
| 3,991,537 | 11/1976 | Brown | 248/345.1 X |
| 4,196,552 | 4/1980 | Bartlett | 256/59 X |
| 4,200,261 | 4/1980 | Bartlett | 256/59 |

*Primary Examiner*—Andrew V. Kundrat

*Attorney, Agent, or Firm*—William R. Laney; Christopher H. Morgan

[57] ABSTRACT

A handrail having an elongated trim piece received on an elongated retainer. The retainer has a medial portion, a handgrip portion and a retainer flange portion, the handgrip portion having a vertical support member which provides a substantially rigid support of the trim piece with respect to a vertically downward force. The trim piece is made of a resilient material adapted to flex toward the retainer upon impact. The trim piece has a medial portion, a handgrip portion and a flange portion. The trim piece joins closely with the retainer to avoid dirt and germ traps. Preferably, an end cap is provided to close the end of the rail. The end cap has two mating wall members which form an interior space. A fastener disposed within the interior space connects the end cap to the retainer. The wall members have interlocking pieces within the interior space to interlock the two mating wall members when they are joined.

19 Claims, 4 Drawing Figures

IMPACT ABSORBING HANDRAIL AND END CAP

BACKGROUND OF THE INVENTION

1. Field of the Invention

This invention relates in general to handrails.

2. Description of the Prior Art

At the present time handrails are used for a variety of purposes. Their principal purpose, of course, is to provide a handhold for persons walking or climbing nearby. When used for this purpose, the handrail must be firmly mounted to provide an easily grasped and rigid support. Various handrail systems ranging from simple wooden sections to metal or rubber sections have been used quite satisfactorily for these purposes.

In many situations, however, such simple handrails have not proved satisfactory. For example, in hospitals, nursing homes and similar institutions, handrails are often provided along walls and in certain rooms and these handrails are quickly damaged. When in this type of use, the handrail is subject to a great deal of abuse. Moving equipment such as food carts, rolling beds, large pieces of test apparatus and the like often come into contact with the handrail as the equipment is moved. This can cause the handrail to be dented, damaged and perhaps even weakened to the point where it provides a dangerous support to those who might rely on them. As can be seen, handrails used in this environment must therefore be not only a rigid support, but also an impact resistant and resilient guard for the wall. U.S. Pat. No. 3,825,229 to Bartlett shows a handrail designed to be used in such an environment. The handrail of Bartlett is comprised of an inner retainer of extruded aluminum which supports an outer trim piece of resilient plastic. These pieces are of uniform cross section and so can be easily extruded. The trim piece of Bartlett is shaped and positioned on the retainer such that the medial portion of the trim piece can flex inwardly toward the medial portion of the retainer, thereby providing a resilient impact surface on the front of the handrail. This protects the aluminum retainer from being damaged by some horizontal impacts. The uppermost part of the trim piece of the Bartlett handrail forms a handgrip area. This area of the trim piece has a convexly curved shape. The Bartlett patent states that this handgrip area must be substantially rigid. This is achieved by the aluminum retainer having a matingly convexly curved portion which supports the major part of the handgrip from underneath.

Thus, the Bartlett patent requires that both the trim piece and the retainer have a convexly curved handgrip portion. Bartlett further requires that the curved portion of the retainer must be outwardly convexly curved. It is assumed that this outward curving is to allow the medial portion of the retainer more room for inward flexing of the trim piece.

While the Bartlett invention provides a handrail which is substantially improved over a wooden handrail, several disadvantages remain. For one, the convexly curved shape of the retainer uses a substantial amount of material for the support of the handgrip part of the trim piece. This material is not only expensive, but also a hinderance, in that too much rigidity is provided in the handgrip portion. Thus, a substantial blow to any portion of the upper part of a Bartlett handrail transmits much or all of the force to the mounting supports rather than being absorbed by the flex of the trim piece. This can cause either the mounting or the handrail to be damaged. This much rigidity is not required to provide a safe support.

When used in hospitals or nursing homes, it is also important that a handrail be easily cleaned and present a neat appearance. If not easily cleaned, the handrail may be a source of continual contamination to staff and patients who use the handrail. For this reason, it is important to have a handrail which is relatively free from dirt and germ traps. In the Bartlett patent, however, two significant such traps are created at the points where the trim piece joins the retainer. At these points, a groove is created which would be very difficult to clean once dirt or the like were wedged in these grooves. These grooves can also become sticky and unpleasant if a liquid, such as a soft drink or the like, is spilled on the handrail and the sticky substance flows into the grooves. Additionally, these grooves can cause pinched fingers if the finger is in a groove when the trim piece flexes. This unsanitary and unpleasant condition is a significant disadvantage of the Bartlett handrail.

Yet another problem with the Bartlett invention has been ending and turning of the rails. Since the extruded retainer and trim piece are of uniform cross section, the Bartlett handrail must have a special end piece for closing the exposed ends. The end piece shown by Bartlett is an insert which mates with the interior of the end of the rail. This end piece, however, is not satisfactory since the necessity of insertion prevents one of these end pieces from being used to join two parts of a handrail around a corner. Furthermore, the end piece must be shaped to very close tolerances to allow the snug insertion necessary to provide a firm support of the end piece. Finally, it can be seen that the end piece of Bartlett is a complex piece and must therefore be relatively expensive.

SUMMARY OF THE INVENTION

It is accordingly, an object of the present invention to provide an improved handrail which is both sturdy and impact resistant. It is also an object of the present invention to provide such a handrail that is easier to clean. It is also an object of this invention to provide a handrail of simple construction.

Yet another object of this invention is to provide a handrail with a simple and improved end piece. It is also an object to provide such an end piece which can serve more than one purpose.

To achieve these objects, the handrail of the present invention comprises an elongated and rigid retainer which constitutes the primary structural component of the handrail. This retainer is of substantially uniform cross section along its length, and has in cross section a medial portion, a handgrip portion at one end of the medial portion, and a retainer flange portion at the other end of the medial portion. The handgrip portion of the retainer is of inverted T-shaped configuration and includes a substantially monoplanar first support member, a substantially monoplanar second support member extending substantially normal to said first support member and an inwardly facing flange in coplanar alignment with said second support member and extending normal to said first support member. An elongated trim piece is received on the retainer. The trim piece is made of a durable impact-resistant resilient material adapted to flex towards the retainer on impact. Like the retainer, the trim piece is substantially uniform in cross section along its length. Also, like the retainer, the trim piece has a medial portion, a handgrip portion, and a retainer flange. The medial portion of the trim piece is spaced from the medial portion of the retainer to allow the trim piece to flex inwardly upon impact.

The handgrip portion of the retainer engages the handgrip portion of the trim piece. The first support member extends vertically when the handrail is mounted on a wall or the like and thus provides a substantially rigid support of the trim piece with respect to a vertically downwardly directed force. This is the only direction which requires rigid support in order to provide a safe grip surface. The second support member projects outwardly horizontally and resists an inward deformation of the handgrip portion. This horizontal support need not be a rigid support since horizontal rigidity is not required for a safe grip surface. Likewise, the inwardly facing flange of the retainer need only support the handgrip portion of the trim piece sufficiently to prevent the trim piece from disengaging from the retainer.

The flange portion of the trim piece is received on and captured by the retainer flange of the retainer. In this manner, the lower portion of the trim piece is held securely with respect to the retainer.

The handrail of the present invention preferably includes an end piece for capping the end of the handrail. The end piece has a first wall member and a second wall member. The first wall member matingly engages the second wall member to form an end piece which has an interior space and a smooth exterior surface. Joining means, disposed on the interior of the end piece such that the exterior surface is not interrupted, securely joins the first wall member to the second wall member. A securing means disposed on the interior of the end piece such that the exterior surface is not interrupted, rigidly secures the end piece to the retainer.

Preferably, the end piece curves horizontally about 90° to allow the handrail to smoothly connect with a surface disposed parallel to the length of the handrail. This allows the end piece to serve a multiple function. At a corner, the 90° end piece can be used to join two handrails around a corner. If the handrail ends in the middle of a wall, the end piece can be used to smoothly terminate the end of the handrail into the wall.

For a further understanding of the invention, and further objects, features and advantages thereof, reference may now be had to the following description taken in conjunction with the accompanying drawings.

DESCRIPTION OF PREFERRED EMBODIMENTS

Figure 1:
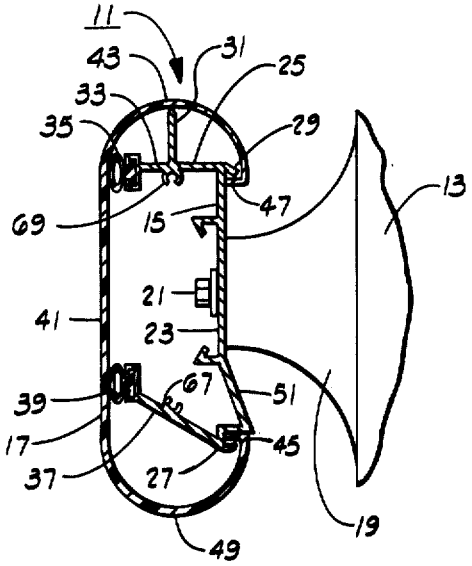
FIG. 1 is an end view in cross section of the handrail of the present invention installed on a wall.

Referring now to FIG. 1, a handrail 11 constructed in accordance with the present invention is shown in cross section attached to a wall 13. The handrail's primary structural component is an elongated retainer 15. Retainer 15 is preferably constructed of extruded aluminum or a similar substantially rigid structural material. Mounted on retainer 15 is an elongated trim piece 17 which is both functional and decorative. The trim piece is preferably constructed of an extrudable plastic or a similar resilient yet durable and impact resistant material. A rigid spacer 19 maintains the handrail 11 in its set-off position in relation to wall 13. Handrail 11 is attached to wall 13 by a bolt 21 which extends through a medial portion 23 of retainer 15, spacer 19 and into wall 13. A nut or other retainer (not shown) inside of or behind wall 13 secures the bolt 21.

Retainer 15 and trim piece 17 are both substantially uniform in cross section along their length. This provides a smooth and uniform handrail surface which runs parallel to wall 13. Spacer 19, however, need not be an elongated piece as is handrail 11. Rather, individual spacers 19 can be placed at intervals along the length of handrail 11 to provide the proper amount of support to the handrail. The number and spacing of the spacers 19 will depend on the load and impact which might be received by the handrail 11.

Retainer 15 has, in cross section, a medial portion 23, a handgrip portion 25 at one end of medial portion 23, and a flange portion 27 at the other end of medial portion 23. The medial portion 23 of retainer 15 forms a rear wall of the handrail 11.

The handgrip portion 25 of retainer 15 has generally an inverted T-shape. The lower, rear leg of this inverted T is attached to the medial portion 23 of retainer 15. An inwardly facing flange 29 extends from the junction of the medial portion 23 of retainer 15 and this leg of the inverted T. A first or vertical support member 31 forms the central leg of the inverted T of the handgrip portion 25. An outwardly facing second or horizontal support member 33 forms the lower, front leg of the inverted T. The front and rear legs, of course, are in substantially co-planar alignment and extend substantially normal to the vertical support member 31. An elongated bumper 35 is attached to the end of member 33 to provide a resilient support. Bumper 35 is preferably made of rubber or other elastomeric material.

Extending from the lower part of medial portion 23 of retainer 15 is the retainer flange 27. This retainer flange 27 extends generally horizontally inwardly. Retainer flange 27 is vertically in line with the flange 29 of handgrip portion 25. Extending outwardly from retainer flange 27 is a lower support member 37. Lower support member 37 forms a smoothly inclined surface which can be used to guide the trim piece into position during assembly. This assembly will be described in more detail subsequently. A bumper 39 is attached to the end of lower support member 37 to provide a resilient support of the front portion of the trim piece which contacts bumper 39. Preferably bumper 39 is made of rubber or other elastomeric material.

Bumpers 35 and 39 are similar in construction and function. Each of these bumpers has a hollow front portion and a T-shaped rear portion. The front portion is hollow to allow a more resilient ability to deform on impact. The T-shaped rear portion is received in a channel-shaped section of the support member. This allows the bumper to be held in place without the use of a separate fastener.

The trim piece 17 is generally a channel-shaped piece having a uniform thickness. The trim piece is received on the retainer and forms the upper, lower and front walls of the handrail. Trim piece 17 has a medial portion 41, a handgrip portion 43 at one end of the medial portion and a lower portion 49 at the other end of the medial portion. The medial portion 41 of trim piece 17 is spaced from the medial portion 23 of retainer 15 to allow the trim piece to flex inwardly upon impact. The handgrip portion 43 at the upper end of trim piece 17 has a convexly and smoothly curved shape. This provides an easily grasped surface. At the end of handgrip portion 43 is a flange 47 extending beneath flange 29 of retainer 51 to hold the trim piece in place. Importantly, the end of flange 47 contacts retainer 15 below flange 29. This creates a substantially continuous exterior surface without a discontinuity between the end of trim piece 17 and retainer 15. If flange 29 encountered the handgrip portion 43 of trim piece 17 and held the flange 47 away from retainer 15 then a groove would be formed which could pinch fingers or trap germs and dirt.

The lower portion 49 of trim piece 17 has a convexly curved shape of the same general shape as the shape of the handgrip portion 43. A flange 45 extends from the end of lower portion 49. Flange 45 engages retainer 15 above retainer flange 27 in the same manner that flange 47 engages retainer 15 below flange 29. This contact prevents a groove from being formed between the end of trim piece 17 and retainer 15. From the above description it can be seen that the trim piece is symmetrical about its horizontal midportion. The upper and lower portions of the trim piece are both convexly curved and end in an outwardly facing flange. Because of this symmetry, the trim piece can be positioned on the retainer with either end up.

While the trim piece has been described with convexly curved upper and lower portions, this type of curved surface is not required. Instead of a convexly curved surface, the trim piece could have a generally rectangular shaped surface. This shape could also be properly supported by the retainer. Most importantly, the vertical support member 31 could provide a substantially rigid support with respect to a vertically downward force applied to the trim piece with this shape. This would provide a safe support as a grip surface and still allow the trim piece to flex and absorb shock in response to impacts in other directions. A variety of other shapes would meet these same requirements.

To position trim piece 17 on the retainer 15 after it has been attached to the wall 13, flange 47 is first placed beneath flange 29. During this placement, the bottom part 49 of trim piece 17 extends outwardly away from the retainer 15. Maintaining flange 47 in position, the lower portion 49 is then rotated toward the lower support member 37. As the lower portion is rotated, flange 45 encounters lower support member 37 at its outward end and then slides down member 37 causing trim piece 17 to flex slightly. As flange 45 nears its position above flange portion 27 the front part of trim piece 41 encounters bumpers 35 and 39. When retainer flange 45 is positioned above flange portion 27, the trim piece 17 is held securely on the retainer 15. Bumpers 35 and 39 urge the trim piece horizontally outwardly. The handgrip portion 43 and lower portion 49 of trim piece 17 are slightly flexed and are under tension. This urges flanges 45 and 47 into close contact with retainer 15.

The lower part of the medial portion 23 of retainer 15 curves to provide an inclined cover section 51 above flange 45. The lower part of cover section 51 engages the upper part of flange 45 and extends slightly beyond the edge of flange 45 so as to completely cover and seal the flange. This importantly prevents any debris or liquid from gathering on the upper side of flange 45. If liquid is spilled on the handrail, cover section 51 directs the liquid out away from flange 45. This makes the handrail easier to clean and avoids creating a dirt or germ trap. The flexed tension of trim piece 17 maintains the contact of flange 45 with the lower part of cover section 51.

While frontal impacts are most frequent, the handrail 11 is likely to receive abuse from all directions. For this reason, the handrail of the present invention is designed to absorb impacts from all directions except those that require a rigid support in order to provide a safe grip surface. The only direction with which the handrail must provide a substantially rigid support is in a vertically downward direction. Vertical support member 31 provides the rigid support in this direction. Other than this rigid support the trim piece is able to flex in all directions to absorb impacts. Handrail 11 can absorb these impacts through two mechanisms. First, bumpers 35 and 39 allow the entire front portion of the handrail to move inwardly in response to an impact. Secondly, the resilient trim piece can flex toward the retainer, the ends of the trim piece being placed in tension during this flexion. Thus, impacts to any portion of the trim piece other than the portion directly above vertical support member 31 produce a flexing motion of the trim piece. Only in response to a vertically downward impact will the trim piece not be able to flex. This flexibility produces the maximum amount of impact absorption while maintaining a safely rigid response to a vertically downward force as when being relied on as a grip surface.

Figure 2:
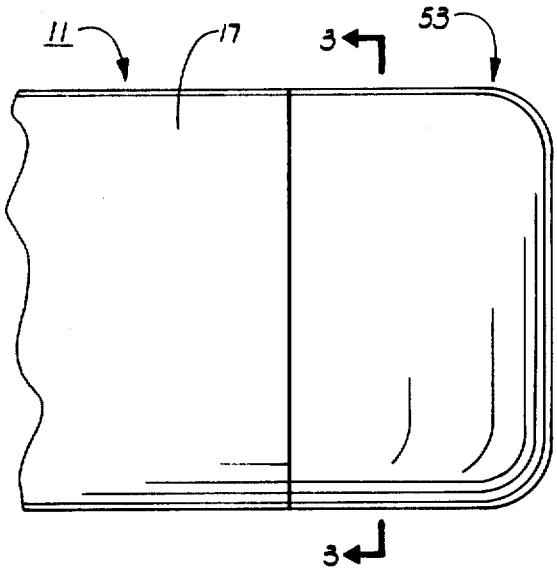
FIG. 2 is a front plan view of the handrail and end cap of the present invention.
Figure 3:
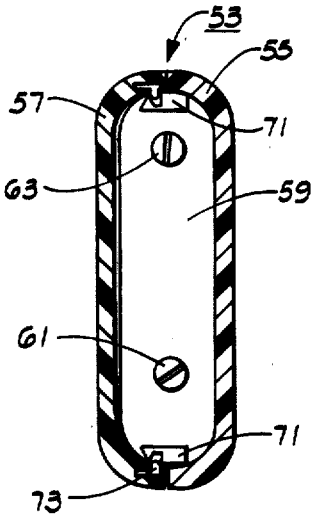
FIG. 3 is a cross-sectional view of the end cap shown in FIG. 2.
Figure 4:
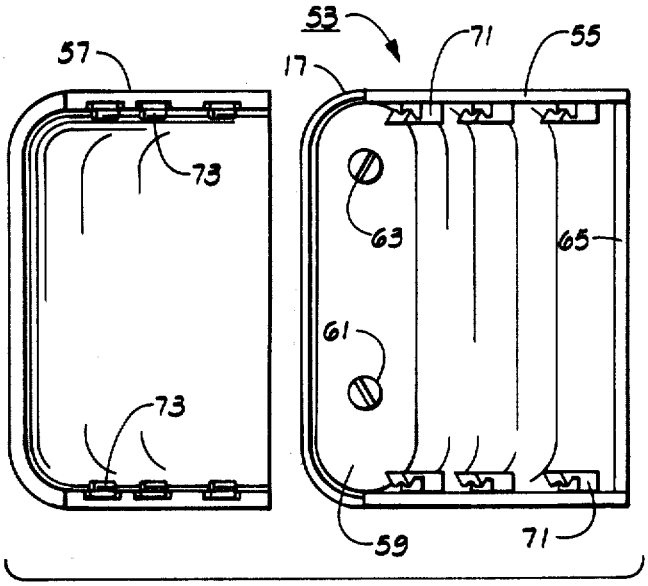
FIG. 4 is an exploded end view of the end cap of the present invention.

Referring now to FIGS. 2, 3, and 4, an end cap 53 is shown which can be used for either closing the end of handrail 11 at a wall or connecting two handrails at a corner. As shown in FIG. 2, the end cap 53 joins smoothly to handrail 11 in a substantially continuous surface. The cross-sectional view of FIG. 3 shows that the outer cross-sectional surface of the end piece 53 closely matches the outer cross-sectional surface of trim piece 17. This creates a smooth junction between the end cap and the trim piece.

End cap 53 is comprised of an inner wall member 55 and an outer wall member 57. Inner wall member 55 matingly joins with outer wall member 57 to form the substantially continuous exterior surface of the end cap. When the outer wall member 57 is removed from inner wall member 55, access can be had to the area inside end cap 53. This allows end cap 53 to be joined by screws to handrail 11 without interrupting the exterior surface of either the handrail 11 or the end cap 53. This also prevents the joining screws from being visible from the exterior of the end cap.

As can be seen in FIG. 4, end cap 53 curves horizontally and uniformly through an arc of 90°. This allows the handrail to smoothly connect with a surface disposed parallel to the length of the handrail. In a first use, end cap 53 can connect one handrail to another at a corner. This can either be an interior or an exterior corner. In connecting two handrails at a corner, the end cap must curve through a distance equal to the distance between the two handrails. A second use of end cap 53 is to terminate a handrail in the middle of a wall. In this use it is normally desirable not to connect the end cap directly to the wall, but to allow a small space between the wall and the end of the cap, e.g., one-eigth of an inch. Therefore, the end cap 53 must curve through a distance equal to the offset provided by spacer 19, minus the spacing distance between the end of the cap and the wall. As can be readily understood, a standard size end cap 53 can be used if a standard size spacer 19 is used, and the distance between handrails to be joined is properly adjusted.

At each end of the inner wall member 55 a mounting flange or wall is provided to allow the end cap to be secured to the handrail. As shown in FIG. 4, the left mounting wall 59 is attached to the handrail by screws 61 and 63. The right mounting wall 65 is shown unattached although it would normally be connected to another handrail or closely spaced from an adjacent wall.

Screws 61 and 63 extend through mounting wall 59 into receiving slots 67 and 69 formed in retainer 15. These slots are semi-circular and can be formed in the extrusion process. Slot 67 is formed in the lower horizontal support member 37. Slot 69 is formed in the handgrip portion 25. They are located approximately along the central vertical axis of the handrail.

Extending from the upper and lower interior end of inner wall member 55 are three pairs of flanges 71. These flanges 71 have a pyramidal point which points upwardly on the upper flanges and downwardly on the lower flanges. Three pairs of protuberances 73 in the interior of outer wall member 57 are disposed to receive and capture the flanges 71. Thus, after the outer wall member 57 has been joined to inner wall member 55, the flanges 71 resiliently engage and interlock with the protuberances 73, the pyramidal points of the flanges being retained behind the protuberances. The flanges 71 are sufficiently resilient to allow the inner wall member to be pressed or snapped into place. The flanges 71 and protuberances 73 are disposed on the interior of end cap 53 such that the continuity of the surface of end cap 53 is not interrupted and the joining parts are not visible from the exterior of the end cap.

To assemble the end cap on a handrail, the inner wall member 55 and its mounting wall 59 is positioned over the end of retainer 15 and screws are inserted through the mounting wall into their corresponding slots in retainer 15. Screw 61 is screwed into slot 67 and screw 63 is screwed into slot 69. Mounting wall 65 can either be attached to a handrail at a corner or can be closely spaced to an adjacent wall. If, for example, the end cap is to be connected to a perpendicularly running handrail at a corner, screws would be inserted through mounting wall 65 into the appropriate slots in the retainer of the other handrail. Following the attachment of the mounting wall 65 to a handrail, the outer wall member 57 is snapped into place on inner wall member 55.

Both inner wall 55 and outer wall member 57 can be molded out of plastic. A fairly rigid plastic is preferred. The mounting walls 59 and 65 can be molded as part of either the inner wall member 55 or the outer wall member 57, depending on which would provide a more convenient access to the interior of end cap 53. Since exterior corners are most common, it is preferred to mold the mounting walls as part of the inner wall member as shown in FIG. 4.

Since flanges 71 and protuberances 73 are relatively small, these parts can be integrally molded, or they can be formed separately and then attached by glue or the like. Mounting surfaces on the interior of wall members 55 and 57 can be formed to allow easy positioning of these parts.

End cap 53 is symmetrical about a central vertical plane. This allows the end cap and its individual wall pieces to be used with either end connected to the handrail and the other terminating into a wall, i.e., a left or right end cap. This also provides an end cap which can be attached either on an inside corner or an outside corner. On an outside corner what has been called the outer wall member is outermost and the inner wall member is innermost. On an inside corner, however, the inner wall member is outermost and the outer wall member is innermost.

From the above description it can be seen that the handrail of the present invention is well adapted to attain the objects and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A handrail comprising:

an elongated, substantially rigid retainer of substantially uniform transverse cross section and having, in cross section:

a medial portion;

a retainer flange portion at one end of the medial portion;

a T-shaped handgrip portion disposed at the other end of the medial portion, said handgrip portion having:

a substantially monoplanar first support member; and a substantially monoplanar second support member extending substantially normal to said first support member; and an elongated trim piece mounted on the retainer and made of impact-resistant resilient material adapted to flex toward the retainer upon impact, said trim piece having a substantially uniform cross section along its length, and further including, in transverse cross section:

a trim piece medial portion spaced from the medial portion of the retainer and including first and second ends;

a handgrip portion at one end of the trim piece medial portion; and a flange portion at the other end of the trim piece medial portion engaging the retainer flange portion of the retainer; and said first support member providing substantially rigid support of the trim piece with respect to a vertically downwardly directed force by contact with the handgrip portion of the trim piece along a line extending the length of the handrail when the handrail is in use and mounted upon a wall.

2. The handrail of claim 1 wherein the retainer further comprises:

a handgrip portion flange in coplanar alignment with said second support member and extending normal to said first support member; and wherein the trim piece further comprises:

a handgrip flange disposed on the handgrip portion of the trim piece, the handgrip flange engaging the retainer beneath the handgrip portion flange of the retainer.

3. The handrail of claim 1 wherein the medial portion of the retainer includes a section which substantially shields the flange portion of the trim piece when it is engaged with the retainer flange portion of the retainer.

4. The handrail of claim 3 wherein the flange portion of the trim piece engages the retainer above the retainer flange portion of the retainer.

5. The handrail of claim 1 wherein the retainer further comprises resilient means disposed between the trim piece and the second support member of the handgrip portion of the retainer.

6. The handrail of claim 1 which further comprises:

an end piece attached to one end of the retainer, the end piece having a first wall member and a second wall member, the first wall member engaging the second wall member to form an exterior cross-sectional surface closely matching the exterior cross-sectional surface of the trim piece such that the trim piece and end piece join in a substantially continuous exterior surface;

joining means joining the first wall member to the second wall member, and disposed on the interior of the end piece such that the exterior surface of the end piece is not interrupted and the joining means is not visible from the exterior of the end piece; and securing means securing the end piece to the retainer and disposed on the interior of the end piece such that the exterior surface of the end piece is not interrupted and the securing means is not visible from the exterior of the end piece.

7. The handrail of claim 6 wherein the securing means comprises a fastener which extends through the end piece to the retainer.

8. The handrail of claim 7 wherein the end piece curves through an arc of about 90° relative to the longitudinal axis of the elongated retainer to allow the handrail to connect with a surface disposed parallel to the length of the handrail.

9. The handrail of claim 8 wherein the end piece is symmetrical about a central vertical plane.

10. A handrail comprising:

an elongated handrail bar comprised of:

an elongated substantially rigid retainer; and an elongated trim piece received on the retainer; and an end piece attached to one end of the retainer, the end piece having a first wall member and a second wall member engaging the first wall member such that the end piece has an interior space and a substantially continuous exterior surface;

joining means joining the first wall member to the second wall member and disposed on the interior of the end piece such that the exterior surface of the end piece is not interrupted; and securing means securing the end piece to the retainer and disposed on the interior of the end piece such that the exterior surface of the end piece is not interrupted.

11. The handrail of claim 10 wherein the end piece has an exterior cross-sectional surface registering, and in substantially coplanar alignment, with the exterior cross-sectional surface of the trim piece such that the trim piece and end piece present a substantially continuous exterior surface.

12. The handrail of claim 11 wherein a portion of the end piece curves uniformly through an arc of about 90° relative to the longitudinal axis of the handrail bar to allow the handrail to smoothly connect with a surface disposed parallel to the length of the handrail bar.

13. The handrail of claim 12 wherein the end piece is symmetrical about a central vertical plane.

14. The handrail of claim 10 wherein the joining means comprises:

a first interlocking piece connected to the first wall member; and a second interlocking piece connected to the second wall member and mating with and capturing the first interlocking piece.

15. A sanitary handrail comprising:

an elongated substantially rigid retainer of substantially uniform transverse cross section along its length and having, in transverse cross section:

a medial portion;

a retainer flange portion at one end of the medial portion; and a handgrip portion at the other end of the medial portion, the handgrip portion having a vertical support member and an inwardly facing handgrip flange;

an elongated trim piece mounted on the retainer made of a durable impact-resistant resilient material adapted to flex toward the retainer upon impact, the trim piece having a substantially uniform cross section along its length and including in cross section:

a medial portion spaced from the medial portion of the retainer;

a handgrip portion received on the handgrip portion of the retainer such that the vertical support member provides a substantially rigid support of the trim piece with respect to a vertically downwardly directed force, the trim piece matingly engaging the retainer below the handgrip flange; and a flange portion received on and captured by the retainer flange portion of the retainer such that the trim piece matingly engages the retainer, the medial portion of the retainer substantially covering the flange portion of the retainer;

an end piece attached to one end of the retainer, the end piece having a first wall member and a second wall member, the first wall member matingly engaging the second wall member such that the end piece has an interior space and a substantially continuous exterior surface;

joining means for securely joining the first wall member to the second wall member and disposed on the interior of the end piece such that the exterior surface of the end piece is not interrupted and the joining means is not visible from the exterior of the end piece; and securing means for rigidly securing the end piece to the retainer and disposed on the interior of the end piece such that the exterior surface of the end piece is not interrupted and the securing means is not visible from the exterior of the end piece.

16. An end piece for a handrail comprising:

a first wall member symetrical about a central vertical plane;

a second wall member symetrical about a central vertical plane matingly engaging the first wall member such that the end piece has an interior space and a substantially continuous exterior surface;

joining means for securely joining the first wall member to the second wall member and disposed on the interior of the end piece such that the exterior surface of the end piece is not interrupted and the joining means is not visible from the exterior of the end piece.

17. The end piece of claim 16 which further comprises:

securing means for rigidly securing the end piece to a handrail and disposed on the interior of the end piece such that the exterior surface of the end piece is not interrupted and the securing means is not visible from the exterior of the end piece.

18. The end piece of claim 16 wherein the joining means comprises:

a first interlocking piece connected to the first wall member; and a second interlocking piece connected to the second wall member and mating with and capturing the first interlocking piece.

19. The end piece of claim 16 wherein the first and second wall members curve uniformly through an arc of about 90° to allow the end piece to connect a handrail to a surface disposed parallel to the length of the handrail.

* * * * *